United States Patent [19]

Cope

[11] 4,191,607

[45] Mar. 4, 1980

[54] LABEL APPLICATOR

[75] Inventor: Andrew P. Cope, Wilmington, Del.

[73] Assignee: E. I. Du Pont de Nemours and Company, Wilmington, Del.

[21] Appl. No.: 891,399

[22] Filed: Mar. 29, 1978

[51] Int. Cl.[2] ..... B65C 9/18; B65C 9/28

[52] U.S. Cl. ..... 156/384; 156/497; 156/540; 156/541; 156/584; 156/DIG. 33; 156/DIG. 38; 156/DIG. 49

[58] Field of Search ..... 156/384, 497, 541, 542, 156/DIG. 31, DIG. 33, DIG. 37, DIG. 38, DIG. 42, DIG. 48, DIG. 49, 584, 385, 386, 387, 388, 361, 364, DIG. 45

[56] References Cited

U.S. PATENT DOCUMENTS

| | | | |
|---|---|---|---|
| 3,616,016 | 10/1971 | Dirten | 156/542 |
| 3,655,492 | 4/1972 | Burton | 156/541 |
| 4,025,382 | 5/1977 | Del Rosso | 156/497 |
| 4,035,225 | 7/1977 | Hamisch et al. | 156/541 |
| 4,080,239 | 3/1978 | Real et al. | 156/542 |

*Primary Examiner*—Caleb Weston

[57] ABSTRACT

An apparatus is provided for taking up label stock slack as it is advanced out of a printer or other source of labels and locating the label stock properly with respect to the vacuum platen of an applicator for receiving the label then applying it. When the label has been advanced to a location adjacent said vacuum platen, a separate drive pulls the label backing through a stripping device leaving the label in a position released from its backing so that it can be propelled to and acquired by the vacuum platen of the label applicator simultaneously with its release from the backing.

2 Claims, 7 Drawing Figures

LABEL APPLICATOR

DESCRIPTION

TECHNICAL FIELD

This invention relates to an apparatus for applying labels attached to a strip of release coated backing material and more particularly, it relates to an apparatus for propelling the label to an applicator simultaneously with its release from the backing material.

BACKGROUND ART

Modern computer controlled label printers make it possible to print a highly individualized label for each of a series of product units. Such things as contents identification, product weight, and quality control data can be ascertained and a detailed label printed for each package. The term package as used herein is understood to include cartons, containers, bales, etc. for products. The problem presently preventing the most efficient use of these printers is the fact that there has not been found an acceptable means of transferring the label from the printer to the package. At present, the printed labels are handled either manually or mechanically to apply adhesive to the printed label and apply it to the package. The handling of adhesive in this operation is awkward and messy. Precut pressure-sensitive labels carried on a release coated backing material present one alternative to the application of adhesive during the labeling process; however, no mechanism has been found which is capable of coacting with printers of the type described to peel the printed label away from the backing material and position it properly on the applicator.

Pressure-sensitive labels are commonly provided on a backing material which is somewhat more flexible than the label itself. This allows the label to be separated from the backing simply be bending the backing sharply away from the label, which is usually done by drawing the backing over a fairly sharp stripping bar or plate. The less flexible label then separates from the backing and remains relatively straight. To reliably separate the label from the backing using this method requires a great deal of force, however, because the backing must be pulled tightly over a sharp edge to get the required sharp bend. This causes high frictional forces between the backing and the stripping bar which increases with the width of the label and backing strip. The drive mechanism provided in the printers is usually not sufficiently powerful to provide the force required to pull the labels over a stripper bar. In addition, typical drive systems in these printers utilize pins which engage perforations in the backing material so that even if the drive system were powerful enough, the increased force on the pins would tend to tear the backing material.

A solution to this problem is the utilization of an auxiliary drive downstream of the printer to provide enough tension on the backing material to pull it tightly over the stripping bar. However, coordination of the two drive systems so that the label is stripped as it emerges from the printer requires complicated controls since the printer drive advances the label incrementally rather than continuously.

An additional problem is encountered in the handling of pressure-sensitive labels, whether being advanced out of a printer or from a roll of pre-printed labels. This results from the fact that the backing material must be stripped away from the label in order to expose the adhesive side of the label prior to its application to the package and yet the only means of controlling the label is to control the backing to which it is attached. It is common to provide an applicator which includes a vacuum platen to acquire the label from the backing material and hold it with the adhesive surface exposed, so that the vacuum platen can then be moved to contact the package with the adhesive surface of the label. A problem arises, however, in attempting to transfer the label from the backing material to the vacuum platen since the stripping bar is generally stationary and thus the label is propelled forward as the backing is stripped away. This means that either the vacuum platen must be moved with the label or the label must be fully liberated from the backing before being acquired by the vacuum platen.

Neither of these approaches is completely satisfactory. Attempting to coordinate the movement of the vacuum platen with the advance of the label can require complicated controls, and entirely liberating the label before acquiring it results in a lack of positive control of the label so that the label, especially if it is relatively large, may become folded or wrinkled before being acquired by the vacuum platen.

DISCLOSURE OF THE INVENTION

This invention avoids the above problems by allowing the separate functions of printing, peeling, and applying the label to be performed in sequence rather than simultaneously. This is accomplished by an improvement in an apparatus that includes a frame, a label printing machine and a label holder mounted on the frame. The printing machine has a means for advancing labels attached to a release coated backing from a source through the printer as the printing of the label proceeds to a location beyond the printing machine and adjacent the label holder. Alternatively the apparatus includes a supply of pre-printed labels and means for advancing the label stock from the supply to a location adjacent the label holder. The improvement comprises means for pulling the backing material from the label after the label stock has been advanced to said location and means for propelling the label to the label-holder simultaneously with its release from the backing material.

ILLUSTRATED EMBODIMENTS

Figure 1:
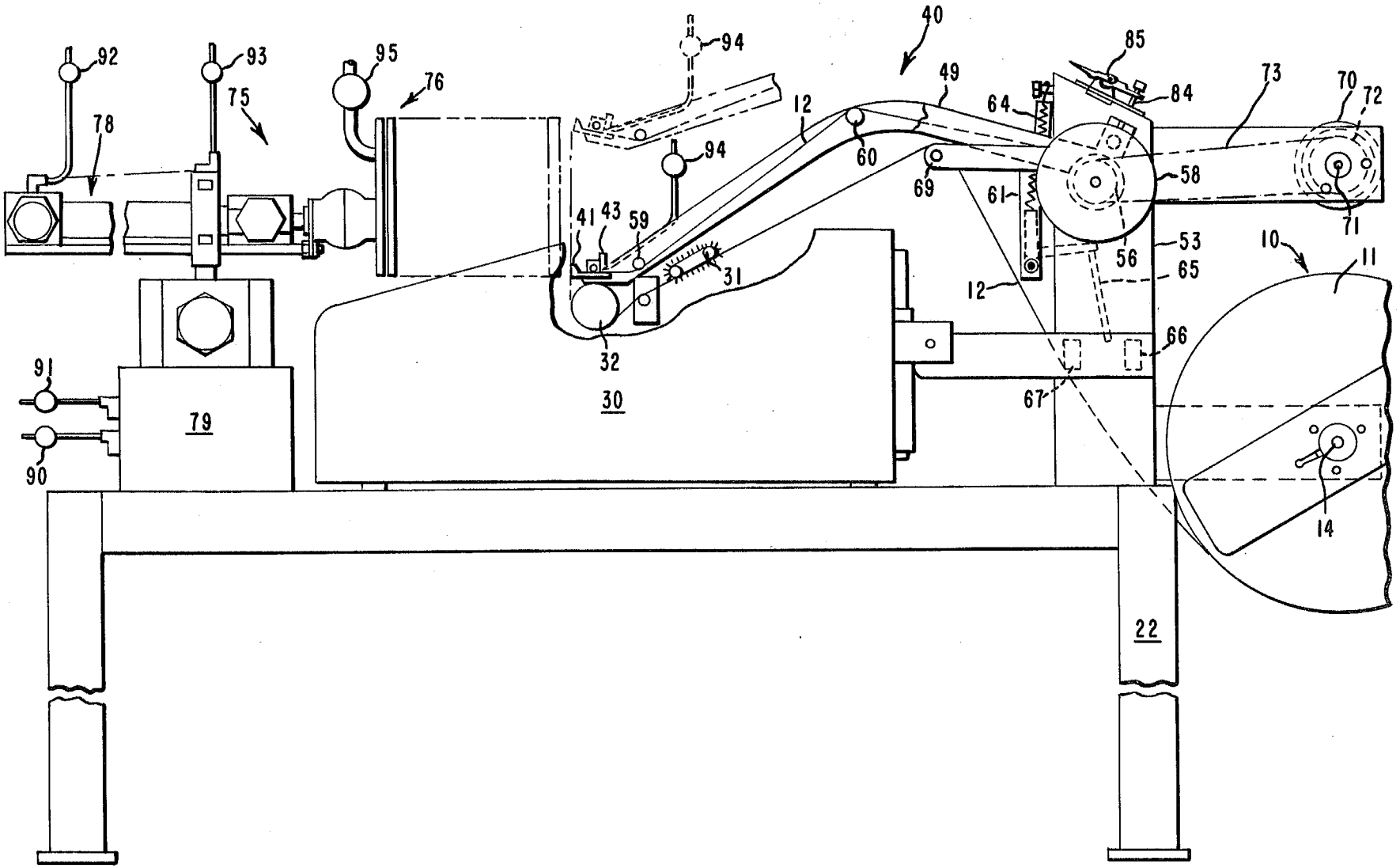
FIG. 1 is a side elevation of the apparatus of the preferred embodiment of the invention.

Referring to FIG. 1, the label printing system chosen for purposes of illustration includes a label supply 10, printer 30, label-stripping mechanism 40, waste take-up reel 70, and label applicator 75.

The label supply 10 includes a roll 11 of label stock 12 comprising backing material to which adhesive labels are releasably secured. Roll 11 is supported by shaft 14, which is rotatably secured to frame 22.

Printer 30 employs an internal drive system 31 utilizing pins which engage perforations in the edge of the label backing material. Movement of these pins propels the backing material with its attached labels forward and maintains accurate positioning of the labels on printing roll 32. Printer 30 is suitably connected to an electronic computer or other source of intelligence and control which causes specific information to be printed on each label. Drive system 31 is suitably controlled so that the labels are advanced in incremental steps over the print roll as successive lines of print are added.

A printer which has been found suitable for this application is the Dataroyal Company Model IPS-7 matrix printer.

Figure 3:
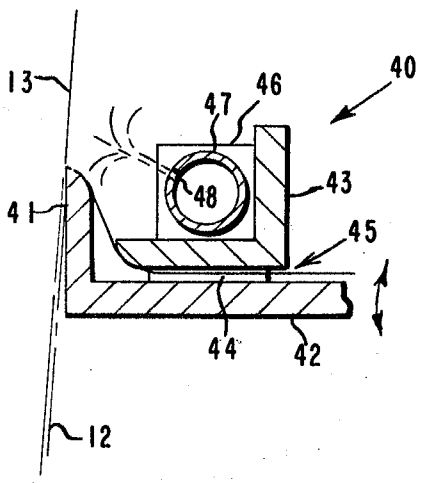
FIG. 3 is an enlarged cross-sectional view of the end of the label-stripping mechanism of FIG. 1.

Label stripping mechanism 40 is best understood by referring to FIG. 3, which shows a blade 41 formed on the upturned edge of support member 42, guide 43 supported at either end by shims 44 affixed to support 42, and a hollow tube 47 supported by blocks 46 secured to guide 43. Tube 47 is connected through valve 94 (FIG. 1) to a source of pressurized air and is provided with a line of perforations 48 extending the length of the tube through which pressurized air is directed toward a point just above blade 41. This assembly is affixed to arms 49, one end of which are pivotally attached to support plates 52, 53 while the other end of the arms carry the assembly.

Figure 2:
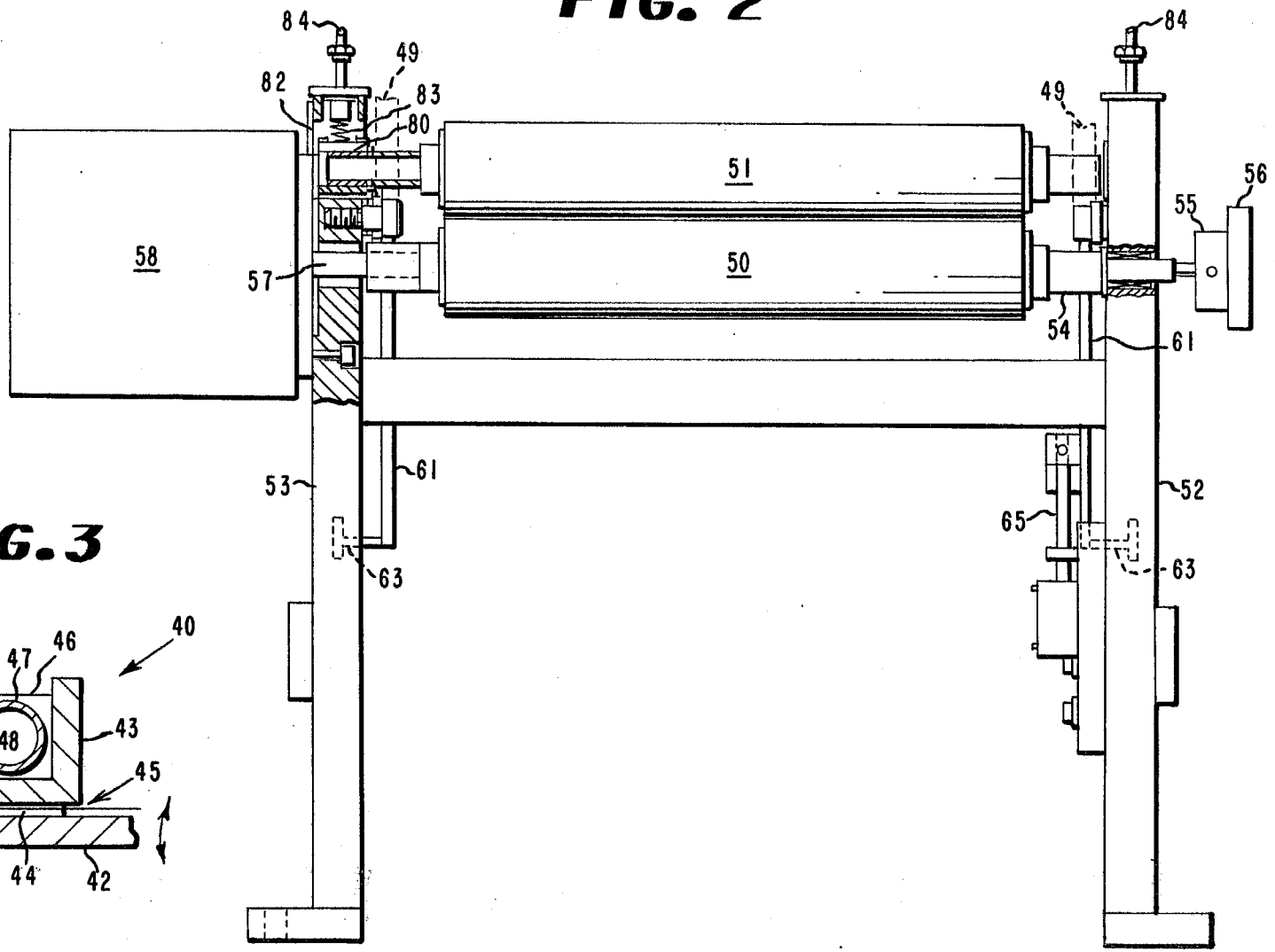
FIG. 2 is a front elevation of the apparatus of FIG. 1.

Also mounted in support plates 52 and 53 are rubber coated nip rolls 50 and 51 (FIG. 2). Lower nip roll 50 is connected to shaft 54 which extends through support plate 52 at one end and is connected by means of slip clutch 55 to pulley 56. The other end of shaft 54 is coupled to shaft 57 of motor 58 which is mounted on support plate 53. Upper nip roll 51 is an idler roll supported by bearings in bearing blocks 80 which are constrained in slots 82 in plates 52 and 53. Bearing blocks 80 are urged downward by springs 83 which are positioned by pistons 84 extending through the top edge of plates 52, 53. Pistons 84 may be raised and lowered by means of toggle actuators 85 (FIG. 1). When pistons 84 are in their uppermost position, roll 51 can be separated from roll 50, and when pistons 84 are forced downward roll 51 is forced against roll 50.

Referring again to FIG. 1, guide bars 59, 60 are secured between arms 49 to form a path between guide 43 and the nip rolls 50, 51. Arms 49 are connected to plates 52, 53 at points colinear with the line of intersection of rolls 50, 51 so that this path is the same length regardless of the position of arms 49.

Projections 61 extend downwardly from arms 49 to support pins 63 (FIG. 2). Tension springs 64 are attached to pins 63 and to plates 52, 53 at a point above arms 49 so that arms 49 are continually urged upward by the force of the springs. Springs 64 are positioned to provide substantially constant force over the stroke of arms 49. Also attached to one of projections 61 is switch actuator 65 which coacts with the electric switches 66 and 67 affixed to plate 52 such that switch 66 is actuated when arms 49 are in their lowermost position and switch 67 is actuated when arms 49 are in their uppermost position.

Take-up reel 70 is supported on shaft 71 which is supported by plates 52 and 53. Shaft 71 is connected by means of pulley 72 and timing belt 73 to pulley 56. Guide bar 69 is supported on plates 52 and 53 in such a position that a path is formed from label supply 10 to printer 30 which keeps the label stock 12 from rubbing contact with other parts of the apparatus.

Label applicator 75 may be any of a variety of devices capable of holding a label with the adhesive side exposed and positioning and applying the label to a package. One example, as shown in FIG. 1, includes a vacuum chamber 76 which is covered by a perforated plate and is connected with a source of vacuum through valve 95. This assembly is carried on the rod of pneumatic cylinder 78 which is carried by rotary actuator 79 by means of which it can be rotated 180° from the position shown. Valves 92 and 93 connect penumatic lines from either end of cylinder 78 to a source of pressurized air, while valves 90 and 91 connect pneumatic lines from rotary actuator 79 to a source of pressurized air such that opening valve 90 causes actuator 79 to rotate 180° from the position shown and opening valve 91 causes actuator 79 to rotate 180° in the opposite direction, returning to the position shown.

Figure 4:
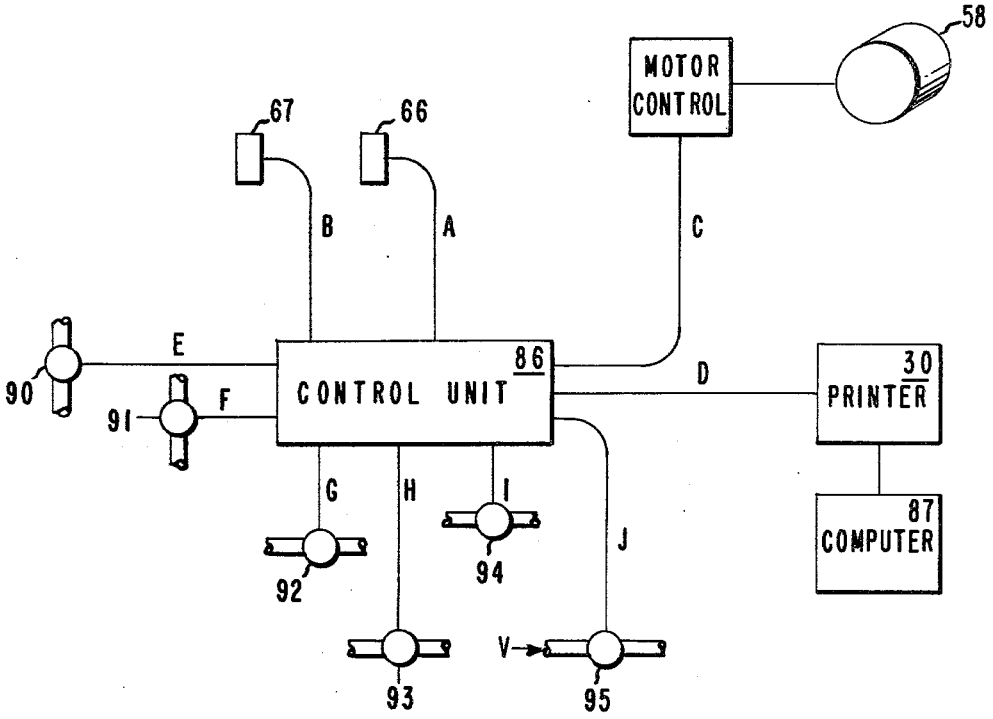
FIG. 4 is a schematic diagram of the control system for the apparatus of FIG. 1.

The control system is shown in block-diagram form in FIG. 4. The system is controlled by means of a programmable control unit 86, for example, a micro- computer such as Intel Company's SBC 80/10. Switches 66 and 67 transmit signals to the control unit 86 over lines A and B, respectively. Line C connects the control unit to the control means of motor 58 so that the motor is turned off or on when the appropriate signal is transmitted by control unit 86. Printer 30 is connected to control unit 86 such that the printer is enabled and can print and propel labels only when the appropriate signal is present in line D. The information printed by printer 30 is determined by a computer 87 external to this system. Pneumatic valves 90, 91, 92, 93 and 94 and vacuum valve 95 are controlled by control unit 86 by means of signals over lines E, F, G, H, I, and J, respectively. Control unit 86 is programmed to generate appropriate signals so that the various parts operate in the sequence described below.

In operation, prior to startup, pistons 84 are raised by means of toggle actuators 85, and the label stock is manually threaded over guide 69, through printer 30, over blade 41 and through the gap 45 between support member 42 and guide 43, over guide bars 59 and 60, and between nip rolls 50 and 51 to takeup reel 70. Pistons 84 are lowered to provide nip pressure between rolls 50 and 51. The label stock 12 is now held immovable in the drive of the printer 30 and between the nip rolls 50, 51. The length of lable stock is adjusted so that arms 49 are held in their lowermost position, thereby causing switch actuator 65 to be in contact with switch 66. Valves 90, 93, 94 and 95 are closed, and valves 91 and 92 are open so that cylinder 78 is in its extended position and in the orientation shown in FIG. 1.

The printer, actuated by the external computer 87 and a signal over line D from the system control unit begins to print a label. As the printing proceeds, line by line, the label is advanced by the drive system in the printer, the slack in the label stock being taken up by an upward movement of arms 49 under force of springs 64. When the label is completely printed and advanced out of the printer, the printer drive stops. At this point, arms 49 are in their uppermost position and switch actuator 65 has engaged switch 67, signalling control unit 86 over line B to begin the label stripping operation. By means of signals over lines I and J, valves 94 and 95 are opened so that pressurized air is supplied to tube 47 and vacuum is supplied to vacuum chamber 76 of the label applicator 75 and motor 58 is signalled over line C to begin rotating the nip rolls 50 and 51 to pull the label stock away from the printer. As the length of material decreases between printer 30 and the nip rolls, arms 49 are drawn downward and the label stock is pulled over blade 41 as shown in FIG. 3. The label 13, being less flexible than the backing, separates from the backing and remains relatively straight. Pressurized air from tube 47 and vacuum from applicator 75 combine to propel the label against the extended vacuum chamber 76 of applicator 75. As arms 49 reach their lowest position, actuator 65 engages switch 66. The air supply to tube 47 is shut off and motor 58 is stopped by control unit 86. The label 13 is now held by vacuum to label applicator 75 and can be attached to a package while a new cycle is begun by a signal from control unit 86 to printer 30 over line D. This print and strip sequence is as described above. Concurrently, cylinder 78 retracts vacuum chamber 76 which is rotated by rotary actuator 79 into a position near the package to be labeled and label 13 is affixed to the package by an extension of cylinder 78 and vacuum chamber 76 which contacts the surface of the package with the adhesive surface of the label. The vacuum to vacuum chamber 76 is turned off and rotary actuator 79 and cylinder 78 return to their initial positions in time to repeat the cycle.

While roll 50 is being driven forward, take-up reel 70 is driven by means of pulleys 72 and 56 and belt 73, rolling up the waste backing material while slip clutch 55 prevents excess tension from building up in the backing material.

Figure 5:
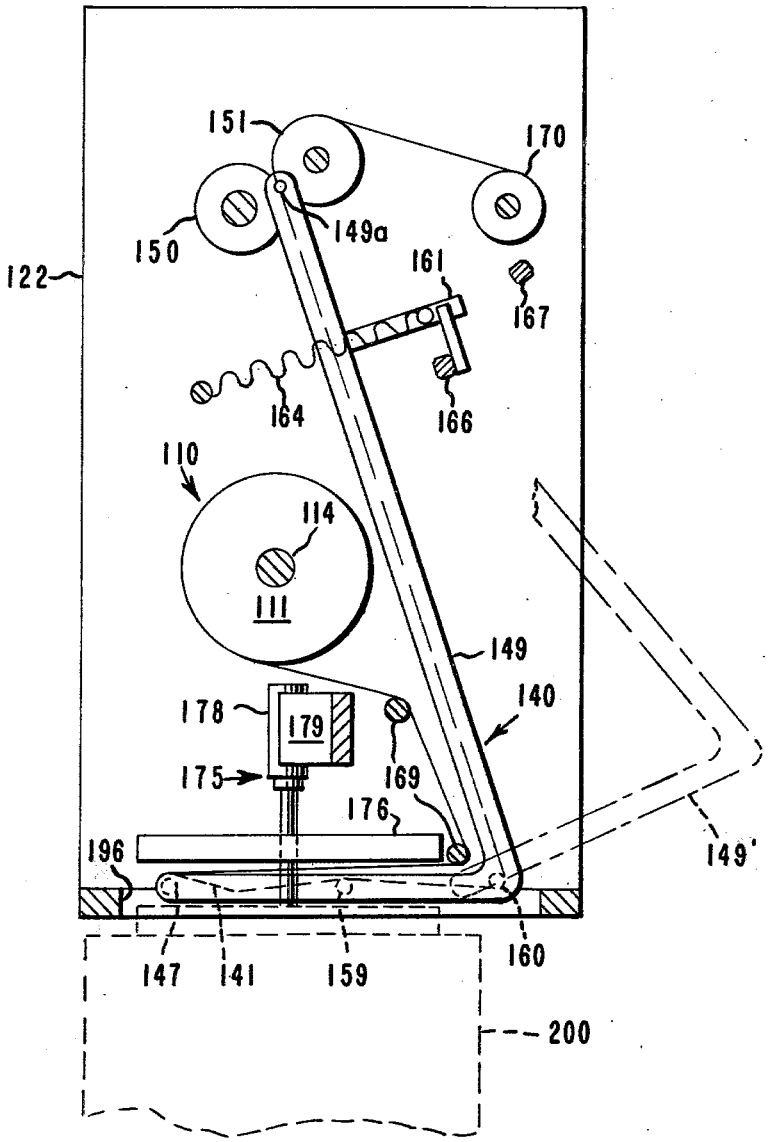
FIG. 5 is a side elevation of an alternate embodiment of the invention.
Figure 7:
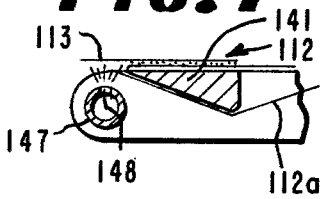
FIG. 7 is an enlarged cross-sectional view of the end of the label stripping mechanism of FIG. 5.
Figure 6:
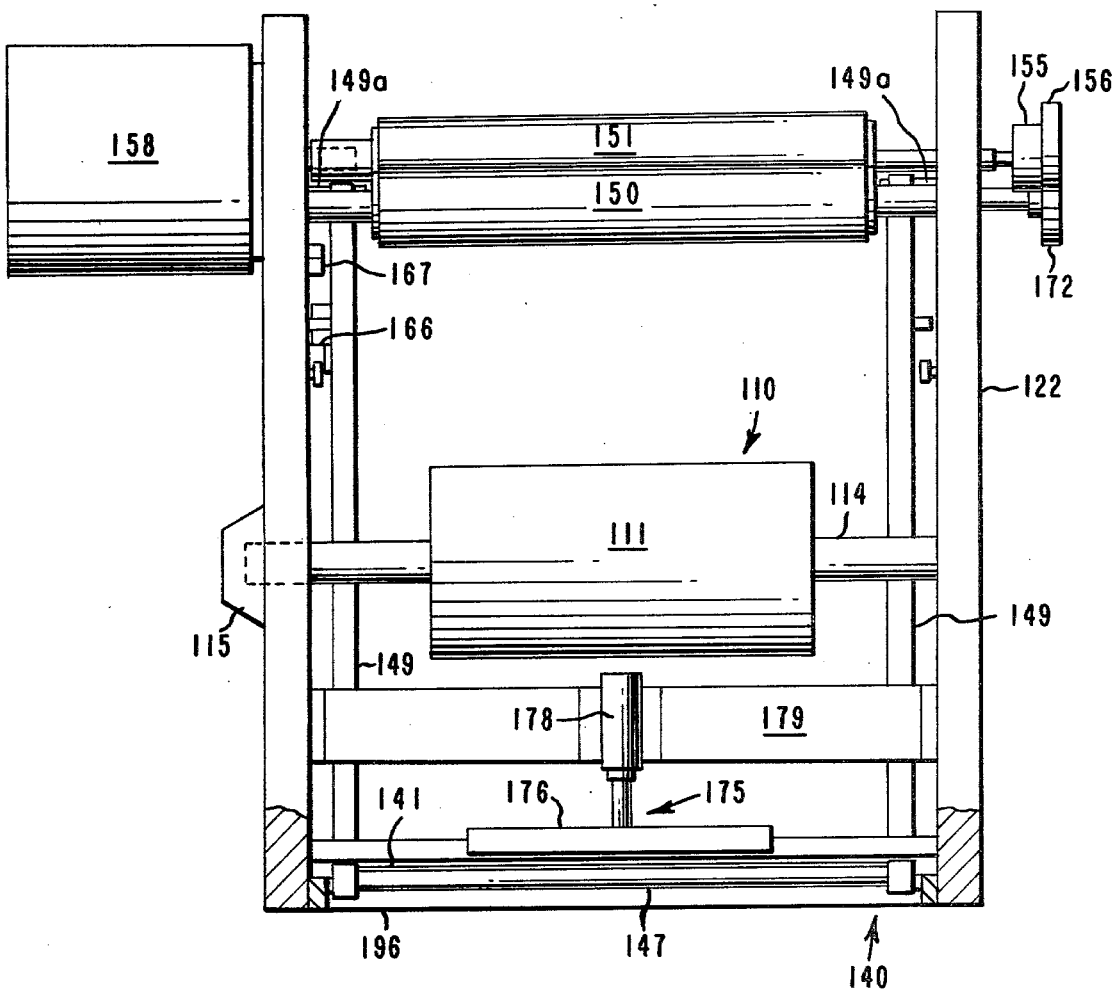
FIG. 6 is a front elevation of the apparatus of FIG. 5.

An alternate embodiment suitable for use with labels which are printed prior to the labeling operation and which is especially useful with relatively large labels that cannot be handled with a stationary stripping bar is shown in FIGS. 5–7. This embodiment generally includes a label supply 110, label-stripping mechanism 140, waste takeup reel 170, and label applicator 175, all supported in frame 122. Label supply 110, includes, in addition to supply roll 111 mounted on shaft 114, an electromechanical brake 115 (FIG. 6) secured to frame 122 for shaft 114. Label-stripping mechanism 140 includes a stripping blade 141 mounted between L-shaped arms 149 near the free ends thereof, the other ends of arms 149 being pivotably attached to frame 122 at pivots **149*a*. Hollow tube 147 is supported between arms 149 beyond blade 141 and is connected to a source of pressurized air (not shown) which is directed through perforations 148 in tube 147 past the tip of blade 141. Nip rolls 150 and 151 and takeup reel 170 are supported by frame 122, roll 150 being directly driven by motor 158 which is mounted on the frame. Roll 150 is also drivingly connected to takeup reel 170 through slip clutch 155 and a timing belt (not shown) from pulley 156 to pulley 172. Guide bars 159, 160, 169 form a path for label stock 112 from the supply 110 to blade 141 and to the nip rolls 150, 151 which is of substantially constant length regardless of the position of arms 149**.

Tension springs 164 are supported on projections 161 from arms 149 and on housing 122 and urge arms 149 to the left as viewed in FIG. 5. Switches 166 and 167 are affixed to frame 122 and switch actuator 165 is attached to one of projections 161, such that switch 166 is actuated when arms 149 are in their leftmost position and switch 167 is actuated when arms 149 are in their rightmost postion 149'.

Label applicator 175 includes a vacuum platen 176 connected to a source of vacuum, not shown, carried on the rod of pneumatic cylinder 178 which is supported by means of brackets 179 from housing 122. The vacuum platen 176 is disposed above an opening 196 in housing 122 such that extensions of cylinder 178 moves the vacuum platen 176 through opening 196 in such position to contact a package 200 placed thereunder. Control of the apparatus is similar to that described in connection with FIG. 4.

In operation, prior to start up, the label stock 112 is threaded around guide bars 169, over blade 141, around guide bars 159 and 160 and between nip rolls 150 and 151 to takeup reel 170. Arms 149 are in their leftmost position thereby causing switch 166 to be engaged and the label stock 112 is adjusted so that a label is centered under vacuum platen 176. Brake 115 is engaged to prevent supply roll 111 from rotating. Vacuum platen 176 is in the raised position and vacuum is off. Air supply to tube 147 is off. A package 200 to be labeled is positioned by conveyor or other means beneath opening 196 in the frame 122. When a label is to be applied, motor 158 is energized by the control system and the backing material is pulled through the nip rolls 151, 150 to waste reel 170. Arms 149 are pulled to the right to position 149' by the backing material which is drawn over the edge of blade 141. At the same time, vacuum is turned onto platen 176 and air is supplied to tube 147. As the backing material of label stock 112 is drawn over blade 141, it separates from the label 113 (FIG. 7) which as it is released from the backing material **112*a* is propelled onto the vacuum platen by a combination of the air from tube 147 and the force of the vacuum from platen 176. When arms 149 reach the position 149', switch 167 is actuated, causing motor 158 and air to tube 147 to be turned off. At this point, label 113 is fully liberated from the backing 112*a* and is held by vacuum to platen 176, and the arms in position 149' are completely out from under vacuum platen 176. Cylinder 178 is extended, contacting the package with the label and vacuum to platen 176 is turned off. Cylinder 178 retracts. Brake 115 is released and tension springs 164 pull arms 149 leftward, causing label stock to be pulled off roll 111 until another label is centered beneath platen 176**. The label applicator is now ready to begin another cycle.

There is thus provided a system of forwarding, stripping, and transferring labels from a backing material to a holder for applying the pressure sensitive labels to a package which maintains positive control of the labels at all times.

I claim:

1. An apparatus for transferring labels from label stock to a label holder comprising: a frame; a movable label holder mounted on said frame; means for positioning and maintaining the label stock at a location opposite and adjacent said label holder, said label stock consisting essentially of labels attached to a release coated backing material, said labels facing said label holder, said means for positioning and maintaining the label stock at a location opposite and adjacent said label holder comprising: an arm pivotally mounted at one end to said frame, the other end of said arm being biased toward said location; means located on said other end of said arm through which the label stock passes for stripping the labels from the release coated backing material; means for pulling said label stock against the bias applied to said other end of said arm and through the means for stripping the labels from the backing material; and means for propelling the label to the label holder simultaneously with its release from the backing material.

2. In a label printing apparatus, that includes a frame, a label printing machine mounted on said frame, said printing machine having means for advancing label stock from a source through a printer as printing of the label proceeds to a location beyond said printing machine, and a movable label holder positioned on said frame adjacent said location, said label stock consisting essentially of labels attached to a release coated backing material, said labels facing said label holder, a device for transferring the label from the backing material to the label holder, comprising: means for positioning and maintaining the label stock at a location opposite and adjacent said label holder as said label stock is advanced from said printing machine, said means for positioning and maintaining the label stock at a location opposite and adjacent said label holder comprising: an arm pivotally mounted at one end to said frame and extending over said printing machine, the other end of said arm being biased away from said printing machine toward said location; means located on said other end of said arm through which the label stock passes for stripping the labels from the release coated backing material; means for pulling said label stock against the bias applied to said other end of said arm and through the means for stripping the labels from the backing material; and means for propelling the label to the label holder simultaneously with its release from the backing material.

* * * * *